US012117275B1

(12) United States Patent
Xu

(10) Patent No.: US 12,117,275 B1
(45) Date of Patent: Oct. 15, 2024

(54) AUTOMATIC ROTATING LIFTING TARGET

(71) Applicant: Xiaoqin Xu, Shantou Guangdong (CN)

(72) Inventor: Xiaoqin Xu, Shantou Guangdong (CN)

( * ) Notice: Subject to any disclaimer, the term of this patent is extended or adjusted under 35 U.S.C. 154(b) by 0 days.

(21) Appl. No.: 18/432,175

(22) Filed: Feb. 5, 2024

(51) Int. Cl.
*F41J 9/02* (2006.01)
*F41J 5/18* (2006.01)

(52) U.S. Cl.
CPC .. *F41J 9/02* (2013.01); *F41J 5/18* (2013.01)

(58) Field of Classification Search
CPC ..... F41J 9/02; F41J 5/18
See application file for complete search history.

(56) References Cited

U.S. PATENT DOCUMENTS

| | | | | |
|---|---|---|---|---|
| 9,702,667 | B1 * | 7/2017 | Gutierrez | F41J 9/02 |
| 2008/0174071 | A1 * | 7/2008 | Potterfield | F41J 9/02 273/366 |
| 2011/0163503 | A1 * | 7/2011 | Townsend | F41J 7/04 273/355 |

FOREIGN PATENT DOCUMENTS

| | | | |
|---|---|---|---|
| CN | 105135951 | A * | 12/2015 |
| CN | 105973074 | A * | 9/2016 |
| CN | 110617742 | A * | 12/2019 |
| KR | 20180121023 | A * | 11/2018 |
| RU | 2722515 | C1 * | 6/2020 |

* cited by examiner

*Primary Examiner* — Jeffrey S Vanderveen

(57) ABSTRACT

An automatic rotating lifting target is disclosed, including a support, a driving mechanism, a rotating frame, and multiple target bodies. The driving mechanism is fixedly arranged at a top of the support. The rotating frame is connected to an output shaft of the driving mechanism and driven to rotate by the mechanism. A periphery of the rotating frame has multiple mounting seats. The multiple target bodies are respectively installed with rotating axles and are easily mounted on corresponding mounting seats of the rotating frame in back and forth flipping manner, and the rotating frame drives these target bodies to rotate. The automatic rotating lifting target has structures of ingenious and practical, without the need for manual flipping or setting up a driving device for flipping. It is featured with low comprehensive cost and very convenient use.

18 Claims, 8 Drawing Sheets

AUTOMATIC ROTATING LIFTING TARGET

TECHNICAL FIELD

The present application relates to the technical field of targets, especially to an automatic rotating lifting target.

BACKGROUND

Currently, there are increasing numbers of entertainment devices on the market, including target shooting games which are popular among consumers. Existing target technologies usually need manual target flipping after being shot, or require setting up a rotating driving component to drive the target body to flip upright. However the shooting games usually have a large number of target bodies, so that the cost for manual flipping of these targets or setting of driving devices would cost too much.

Therefore, an automatic rotating lifting target is needed to solve the above-mentioned technical problems.

SUMMARY

In view of above, the present disclosure aims to provide an automatic rotating lifting target to effectively solve problems of high costs associated with manually flipping each target body or setting up driving components for each target body in the existing technology.

To achieve above objectives, the present disclosure adopts following technical solutions.

In some embodiments of the present disclosure, an automatic rotating lifting target is provided, including a support, a driving mechanism, a rotating frame, and multiple target bodies. Herein the driving mechanism is fixedly arranged at a top of the support. The rotating frame is connected to an output shaft of the driving mechanism and driven to rotate by the driving mechanism. A periphery of the rotating frame has multiple mounting seats. The multiple target bodies are respectively installed rotating axles and can be easily mounted on corresponding mounting seats and flipped forward and backward. When the target body is shot, it flips and tilts backward around the rotating axle. And when the target body rotates to the bottom with the rotating frame, the tilted target body flips forward and stands upright under the action of gravity.

Preferably, the rotating frame further includes a turntable and multiple extension rods. A center of the turntable is fixedly connected to the output shaft of the driving mechanism; one end of the multiple extension rods is fixed to an outer peripheral side of the turntable, and the multiple mounting seats are respectively fixed to the other end of the multiple extension rods; the target body includes a flipping seat and a main body. A rear side of the flipping seat is rotatably connected to a rear side of each mounting seat around the rotating axle, while the main body is fixed onto the flipping seat.

Preferably, the flipping seat and the mounting seat have magnet blocks for mutual magnetic attraction on the side close to each other.

Preferably, the periphery of the turntable is provided with multiple primary fixing columns, and the multiple extension rods are inserted and fixed with the primary fixing columns.

Preferably, the mounting seat is provided with a secondary fixing column, and the multiple extension rods are inserted and fixed with the secondary fixing column.

Preferably, the flipping seat is designed with a connecting groove, which penetrates through the end face of one side of the flipping seat to form a port. And the main body is designed with a connecting block, which is fixed in the connecting groove through the port.

Preferably, the bottom surface of the connecting groove is designed with a positioning protrusion, and the connecting block has a positioning recession for cooperating with the aforesaid positioning protrusion.

Preferably, the rotating axle and the flipping seat are integrally molded, and the mounting seat is provided with a rotating groove for rotating connection with the rotating axle. One side of the rotating groove has an opening for mounting the rotating axle, and the width of the opening is smaller than the diameter of the rotating axle.

Preferably, the extension rods are hollow rods.

Preferably, the turntable includes a rear shell, a front shell, and a front cover. The front shell is fixedly connected to the rear shell in a front-to-back splicing manner, and the front cover is set on the front side of the front shell and has a tapered structure.

Preferably, the multiple extension rods are evenly distributed in a radial manner around the center of the turntable, and extend radially outward.

Preferably, the support includes a base and a column. The column is fixedly connected to the top center of the base and extends vertically, and the top end of the column is fixedly connected to the driving mechanism.

Preferably, the base is a counterweight base.

Preferably, the rotating frame is made of plastic material.

Preferably, the target body is made of plastic material.

Preferably, the driving mechanism includes a housing, a control board, and a reduction motor. The housing is fixed to the top of the support, the control board and the reduction motor are fixed inside the housing, and the output shaft of the reduction motor extends forward from the housing and is fixedly connected to the center of the rotating frame.

Preferably, the housing includes a lower shell, an upper shell, and a rear cover. The upper shell is vertically and fixedly connected to the lower shell to form a receiving chamber. The control board and the reduction motor are arranged in the receiving chamber. And the rear cover covers the rear opening of the receiving chamber.

Preferably, the bottom of the housing has a plug hole, and the top of the support is inserted into the plug hole for fixed connection.

Preferably, the control board has control buttons, which are exposed on the outer surface of the housing.

Preferably, the housing is equipped with a rechargeable battery, which is electrically connected to the control board. The control board has a charging interface, which is exposed on the outer surface of the housing.

Compared with existing technologies, the automatic rotating lifting target of the present disclosure has obvious advantages and beneficial effects. Specifically, from the above technical solutions, it can be seen that, the multiple target bodies, which are respectively installed with rotating axles, can be easily mounted on corresponding mounting seats of the rotating frame, and can flip forward and backward. The rotating frame drives multiple target bodies to rotate, so that the target bodies can rotate and flip around the rotating axles when they are shot. At that time, the target bodies can rotate with the rotating from to the bottom, and the tilted target bodies can reach upright position at the bottom under the action of gravity, thus getting erected and ready for being shot again. The structure is ingenious and practical, needing no manual flipping or setting up driving components for flipping. It helps to reduce comprehensive costs and enables convenient use.

Figure 1:
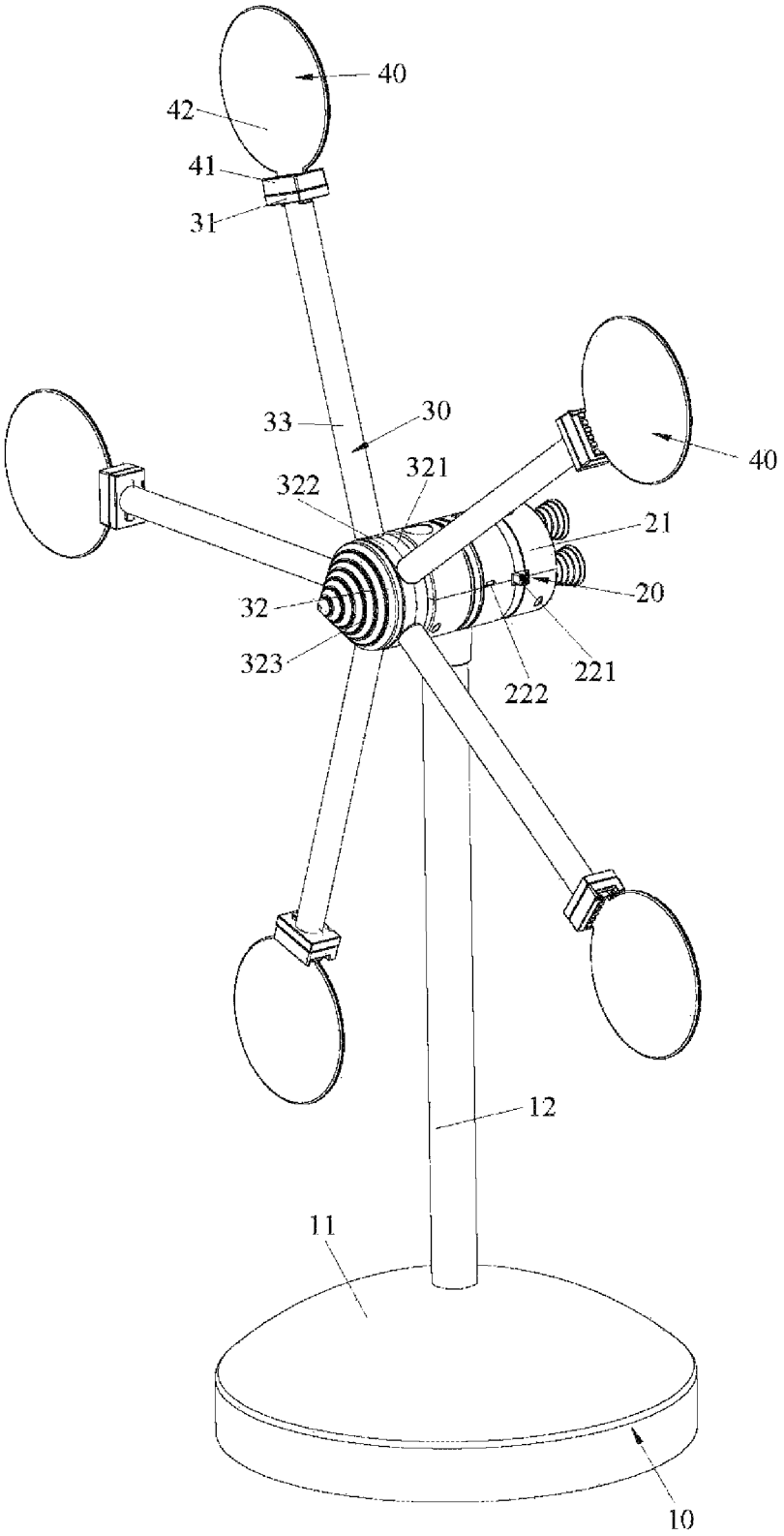
FIG. 1 is the 3D assembly schematic diagram of a preferred embodiment of the present invention.

In the drawings, reference signs are as follows.

| | |
|---|---|
| 10. Bracket | 11. Base |
| 12. Column | 20. Driving mechanism |
| 21. Housing | 211. Lower shell |
| 212. Upper shell | 213. Rear cover |
| 22. Control board | 221. Control button |
| 222. Charging interface | 23. Reduction motor |
| 231. Output shaft | 24. Battery |
| 201. Chamber | 202. Plug hole |
| 30. Rotating frame | 31. Mounting seat |
| 311. Rotating groove | 32. Turntable |
| 321. Rear shell | 322. Front shell |
| 323. Front cover | 33. Extension rod |
| 301. Primary fixing column | 302. Secondary fixing column |
| 40. Target body | 41. Flipping seat |
| 411. Connecting groove | 412. Positioning protrusion |
| 42. Main body | 421. Connecting block |
| 422. Positioning recession | 43. Magnet block |
| 401. Rotating axle | |

DETAILED DESCRIPTION OF THE EMBODIMENTS

Figure 2:
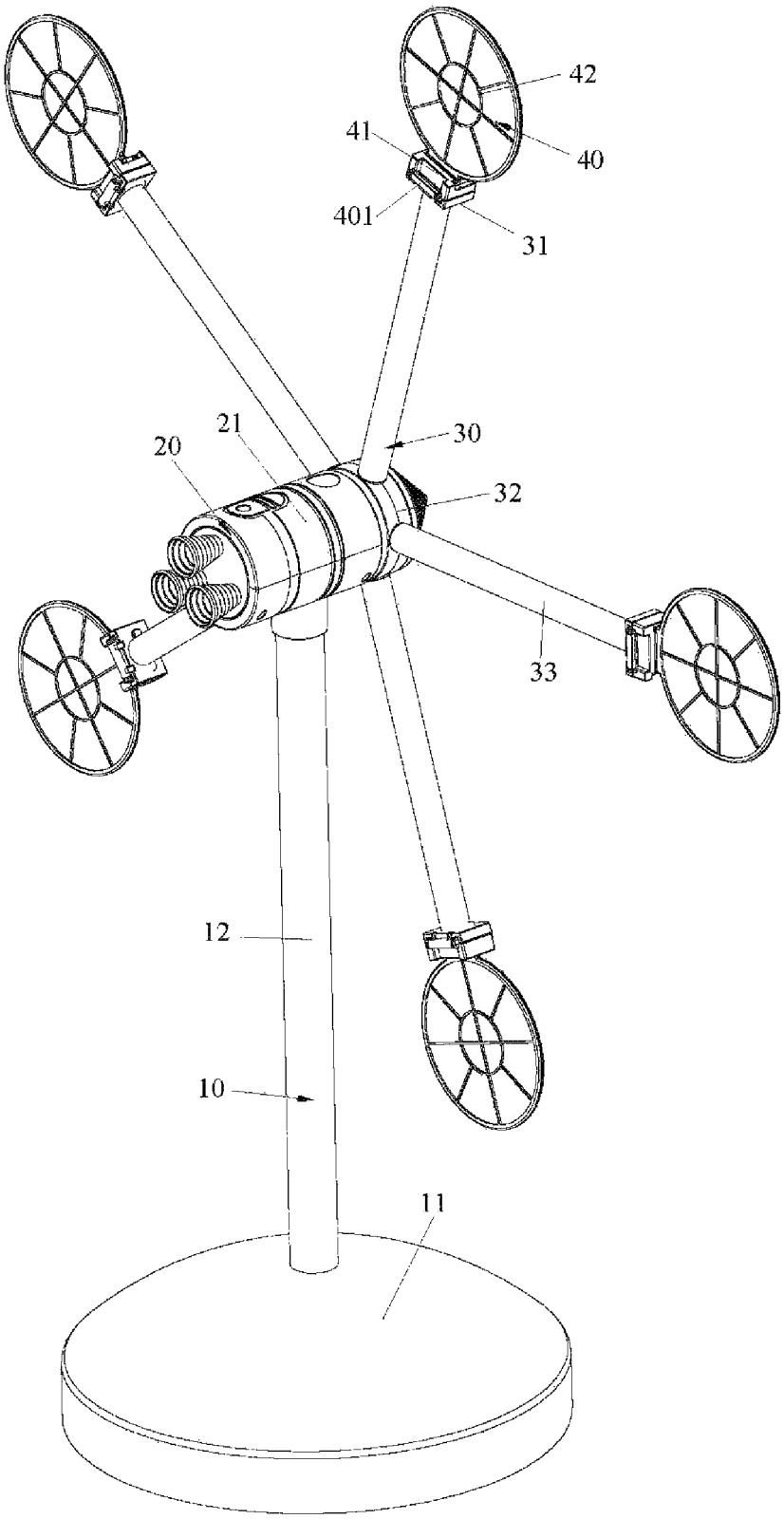
FIG. 2 is the 3D assembly schematic diagram of a preferred embodiment of the present invention from another angle.
Figure 3:
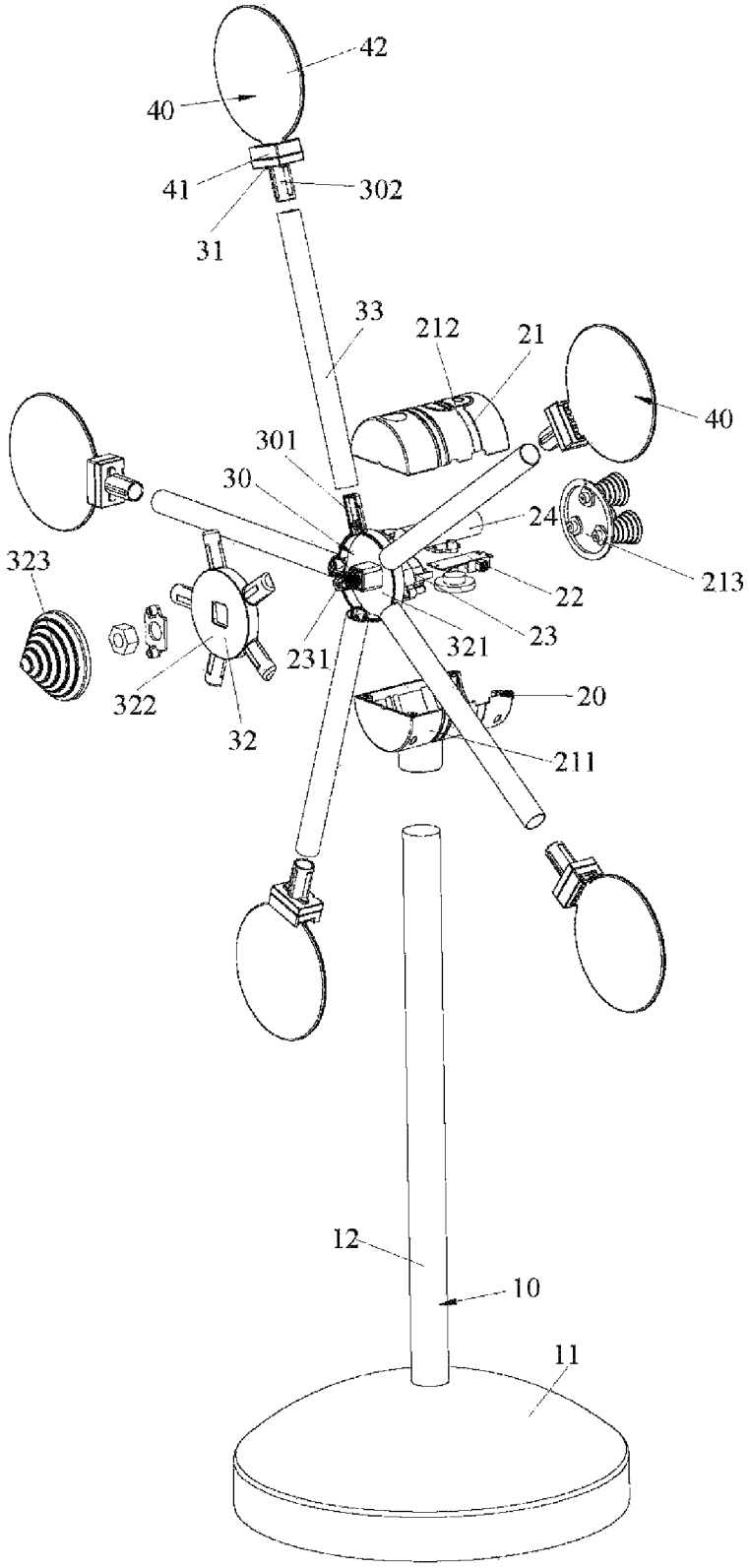
FIG. 3 is the exploded view of a preferred embodiment of the present invention.
Figure 4:
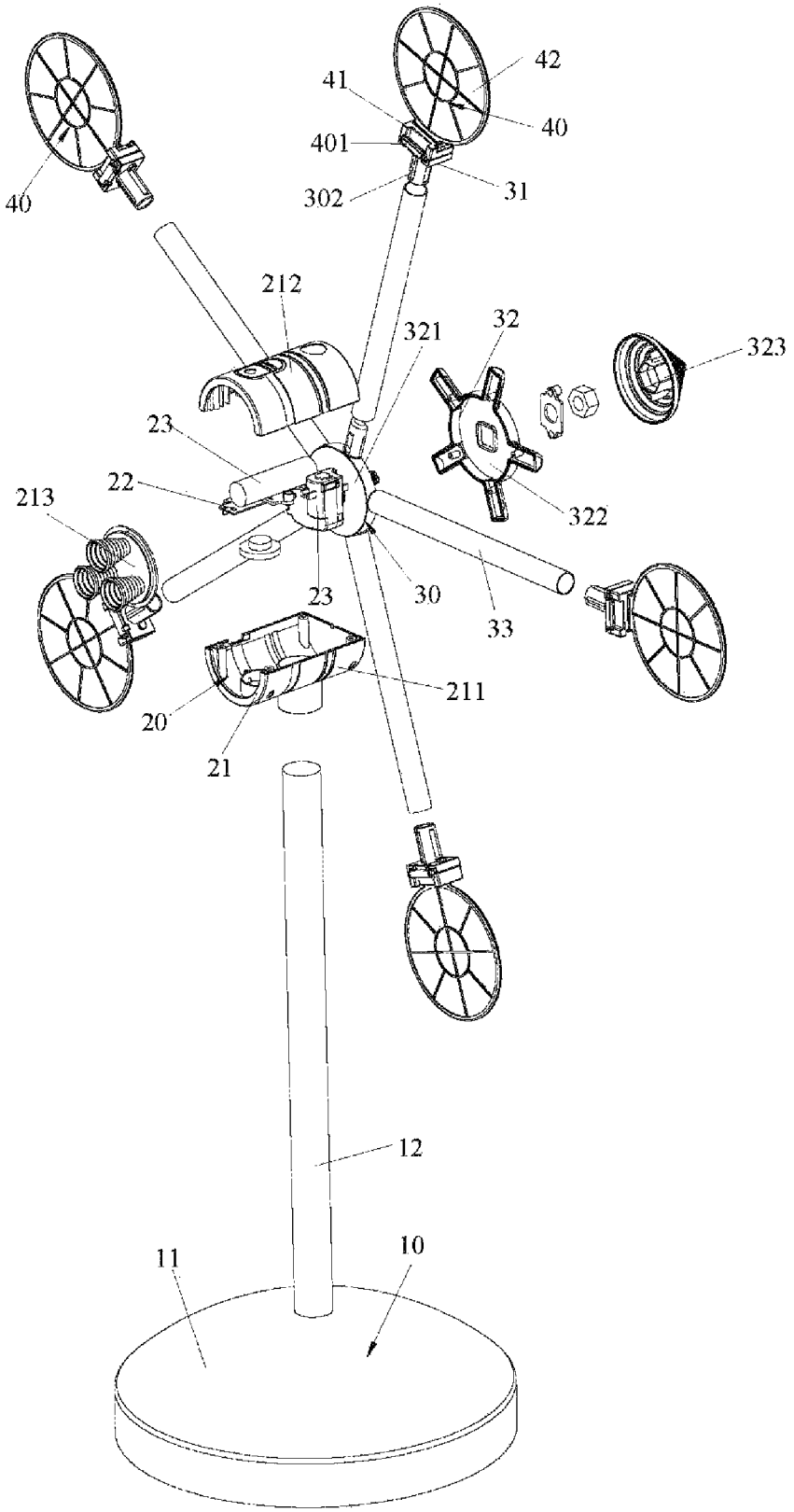
FIG. 4 is the exploded view of a preferred embodiment of the present invention from another angle.
Figure 5:
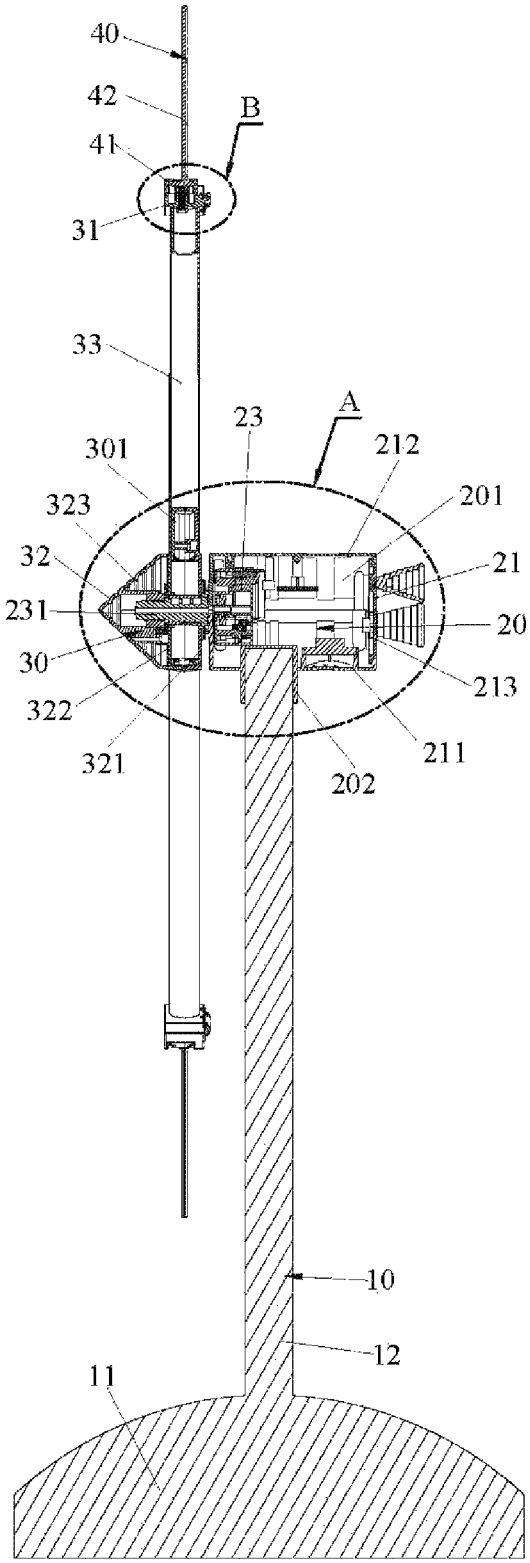
FIG. 5 is the cross-sectional view of a preferred embodiment of the present invention.
Figure 6:
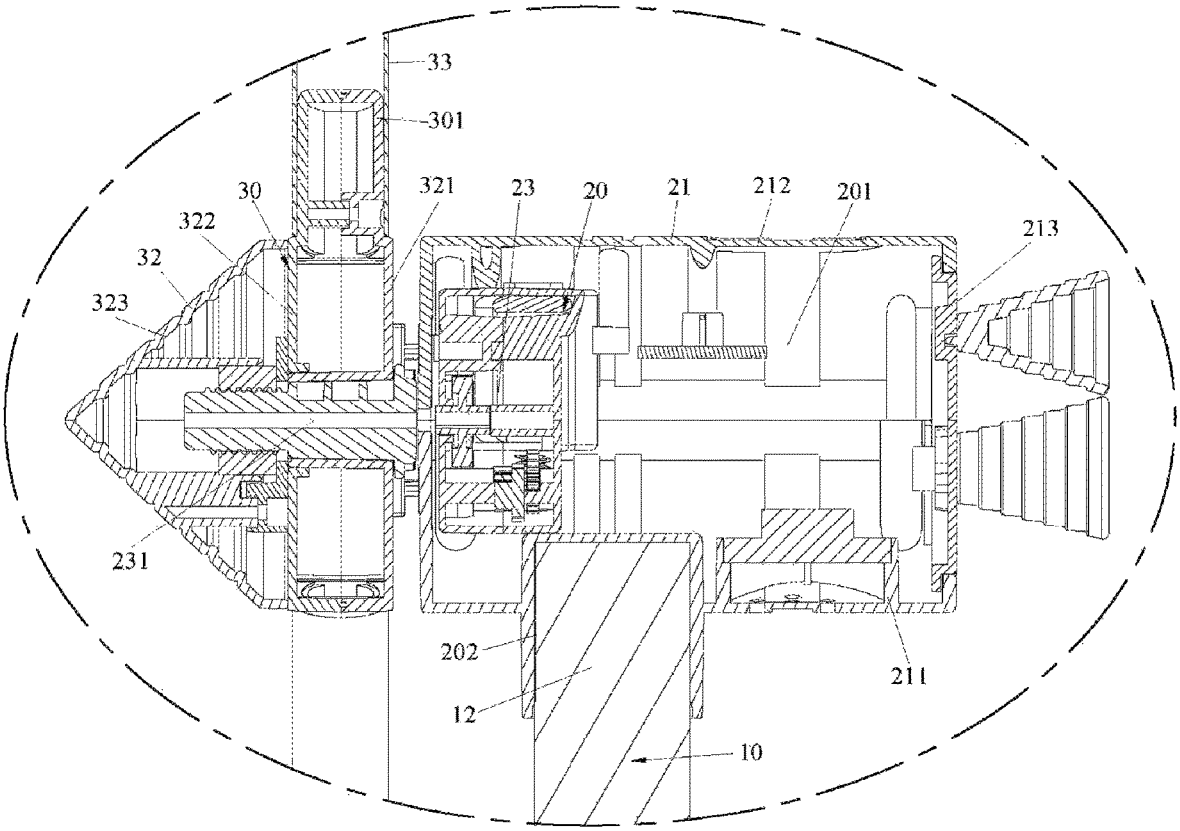
FIG. 6 is the enlarged schematic view of Position-A in FIG. 5.
Figure 7:
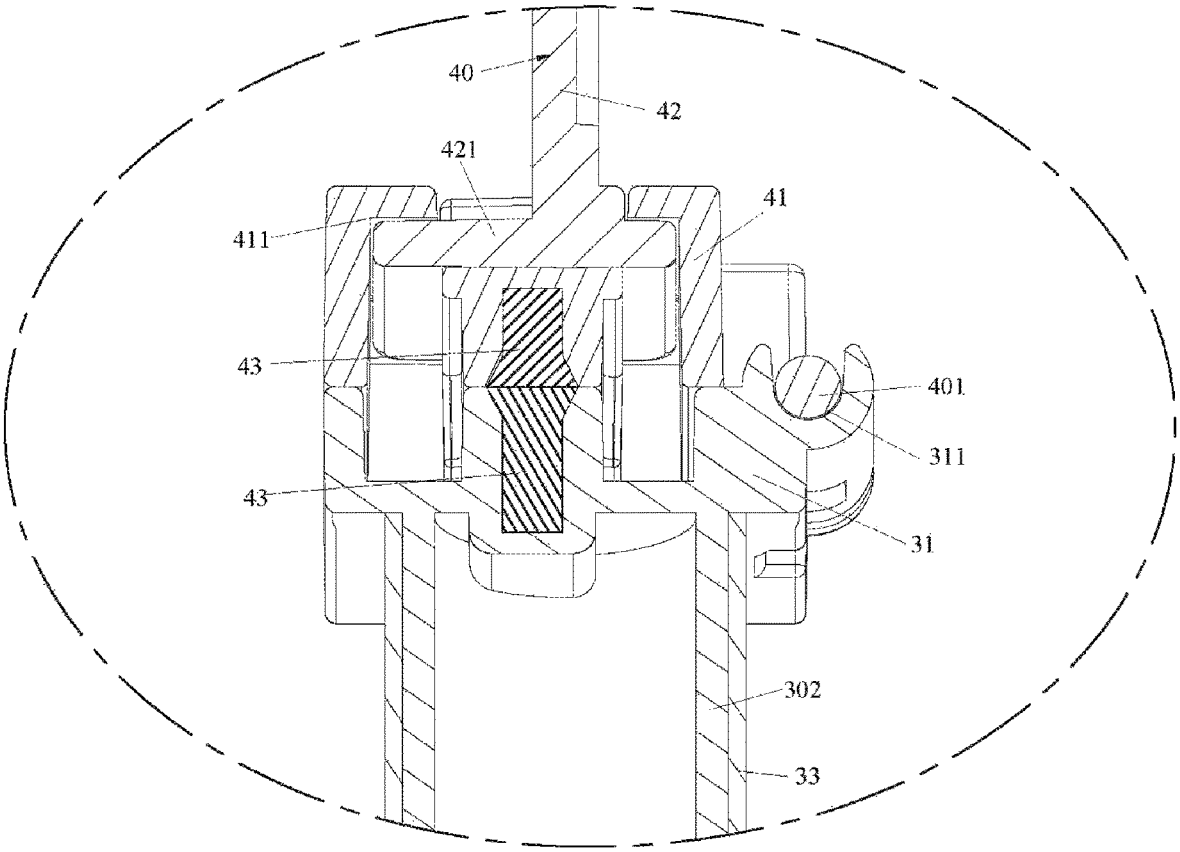
FIG. 7 is the enlarged schematic view of Position-B in FIG. 5.
Figure 8:
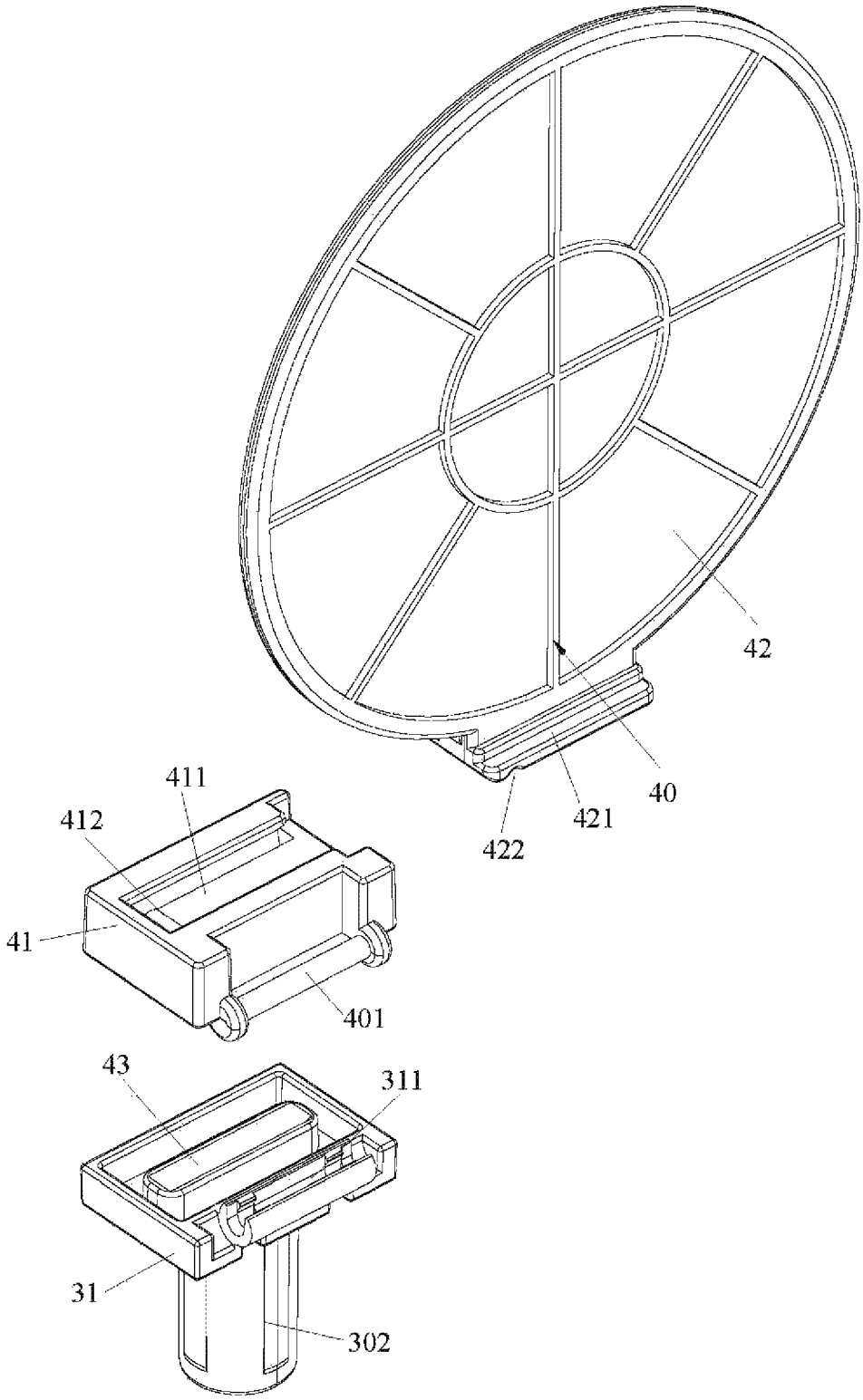
FIG. 8 is the partially-enlarged exploded view of a preferred embodiment of the present invention.

Please refer to FIG. 1 to FIG. 8, which show the specific structure of a preferred embodiment of the present invention, including bracket 10, driving mechanism 20, rotating frame 30, and multiple target bodies 40.

The bracket 10 includes a base 11 and a column 12. The column 12 is fixed to the top center of the base 11 and extends vertically. The base 11 is a counterweight base and can be stably placed on the ground. The column 12 is a solid cylindrical rod structure, which is stable and reliable.

The driving mechanism 20 is fixedly arranged on the top of the bracket 10. The upper end of the column 12 is fixedly connected to the driving mechanism 20. Specifically, the driving mechanism 20 includes a housing 21, a control board 22, and a reduction motor 23. The housing 21 is fixed to the top of the bracket 10. The control board 22 and the reduction motor 23 are fixed inside the housing 21. The output shaft 231 of the reduction motor 23 extends forward from the housing 21. In this embodiment, the housing 21 includes a lower shell 211, an upper shell 212, and a rear cover 213. The upper shell 212 and the lower shell 211 are vertically spliced and fixed to form a chamber 201. The control board 22 and the reduction motor 23 are both arranged in the chamber 201. The rear cover 213 covers the rear opening of the chamber 201. In addition, the bottom of the housing 21 has a plug hole 202, and the top of the bracket 10 is inserted into the plug hole 202 for fixed connection, that is, the top of the column 12 is inserted into the plug hole 202 for fixed connection. Furthermore, the control board 22 is equipped with a control button 221, which is exposed on the outer surface of the housing 21 for controlling the reduction motor 23. In addition, the housing 21 is equipped with a battery 24, which is electrically connected to the control board 22. And the control board 22 is equipped with a charging interface 222, which is exposed on the outer surface of the housing 21 for charging the battery 24.

The rotating frame 30 is connected to the output shaft of the driving mechanism 20 (i.e., the output shaft 231 of the reduction motor 23) and is driven to rotate by the driving mechanism 20. The periphery of the rotating frame 30 has multiple mounting seats 31. Specifically, the rotating frame 30 also includes a turntable 32 and multiple extension rods 33. The center of the turntable 32 is fixedly connected to the output shaft of the driving mechanism 20. One end of the multiple extension rods 33 is fixed to the outer peripheral side of the turntable 32, and the multiple mounting seats 31 are respectively fixed to the other end of the multiple extension rods 33. In this embodiment, the output shaft 231 of the reduction motor 23 is fixedly connected to the center of the rotating frame 30. The rotating frame 30 is made of plastic material, which is low in cost and light in weight. The turntable 32 includes a rear shell 321, a front shell 322, and a front cover 323. The front shell 322 is fixedly connected to the rear shell 321 in splicing connection manner, and the front cover 323 is set on the front side of the front shell 322 and has a conical structure. The extension rods 33 are hollow rods, which are light in weight. The design of the extension rods 33 makes the driving mechanism 20 able to rotate the rotating frame 30. The multiple extension rods 33 are evenly spaced around the center of the turntable 32 and extend radially outward. In addition, the periphery of the turntable 32 is provided with multiple primary fixing columns 301, and the extension rods 33 are inserted and fixed with the primary fixing columns 301, forming a structure featured with simple shape, convenient assembly, disassembly and storage. The secondary fixing columns 302 are provided on the mounting seats 31, and the extension rods 33 are inserted and fixed with the secondary fixing columns 302, forming a simple structure featured with convenient assembly, disassembly, and storage.

The multiple target bodies 40 are respectively installed on the corresponding mounting seats 31 by the rotating axle 401. When the target bodies are shot, they can rotate and tilt backward around the rotating rotating axle 401. When the target bodies 40 rotate with the rotating frame 30 to the bottom, the tilted target bodies 40 can be flipped forward and stand upright under the action of gravity. In this embodiment, the target bodies 40 are made of plastic material, which is low in cost and light in weight. Specifically, the target bodies 40 include a flipping seat 41 and a main body 42. The rear side of the flipping seat 41 is rotatably connected to the rear side of the mounting seat 31 by the rotating axle 401. And the main body 42 is fixed on the flipping seat 41. The flipping seat 41 and the mounting seat 31 are provided with magnet blocks 43 for mutual magnetic attraction on the sides close to each other. By setting the magnet blocks 43, the tilted target bodies 40 can be stably maintained in an upright state when the target bodies rotate with the rotating frame 33 the bottom. The flipping seat 41 is provided with a connecting groove 411, which penetrates the end face of one side of the flipping seat 41 to form a port. And the main body 42 is provided with a connecting block 421, which is fixed in the connecting groove 411 through the port, facilitating disassembly and assembly. In addition, the bottom surface of the connecting groove 411 is provided with a positioning protrusion 412, and the connecting block 421 is provided with a positioning recession 422 for cooperating with the aforesaid positioning protrusion 412, thus forming a simple and stable structure that is easy to install. Moreover, the rotating axle 401 and the flipping seat 41 are integrally injection molded, and the mounting seat 31 is provided with a rotating groove 311 for rotating connection with the rotating axle 401. One side of the rotating groove 311 along the axial direction is provided with an opening for installing the rotating axle 401. And the width of the opening is smaller than the diameter of the rotating axle 401, facilitating disassembly and assembly.

For the using of this embodiment, the user shall start the driving mechanism 20 by the control button 221, use the battery 24 to provide power to reduction motor 23 through the control board 22, and use the reduction motor 23 to control the rotating frame 30 to set the start-stop cycle, or to run at a low speed continuously, or to be controlled to rotate by remote control. The user can shoot the target body 40 which rotates to the top of the rotating frame 30 each time. If the target body 40 is tilted by the shot, the tilted target body 40 can rotate and present in vertical status under the action of gravity when the target body 40 rotates to the bottom with the rotating frame 30, thus standing upright for being shot again.

The design focus of the this invention: by installing multiple target bodies on the corresponding mounting seats of the rotating frame by using rotating axles in flipping back-and-forth manner, it allow the rotating frame to drive multiple target bodies to rotate and tilt around the rotating axle when being shot. Under the action of gravity, the tilted target bodies can rotate to upright status when they rotate to the bottom with rotating frame, thus getting erected again for being shot. The structure is ingenious and practical, needing no manual flipping or setting flipping driving devices. It is featured with low comprehensive cost and easy use.

The content above describes the technical principles of the present invention combining with specific embodiment. These descriptions are only for explaining the principles of the present invention and should not be construed as limiting the scope of the present invention in any way. Based on the explanations herein, those skilled in the art can conceive other specific embodiments of the present invention without exerting creative efforts, and all these embodiments will fall within the scope of the present invention.

What is claimed is:

1. An automatic rotating lifting target, comprising a bracket, a driving mechanism, a rotating frame, and multiple target bodies;

wherein the driving mechanism is fixedly arranged at a top of the bracket;

wherein the rotating frame is connected to an output shaft of the driving mechanism and driven to rotate by the driving mechanism;

wherein a periphery of the rotating frame has multiple mounting seats;

wherein the multiple target bodies are respectively installed with rotating axles, and are mounted on corresponding mounting seats in back and forth flipping manner;

when the multiple target bodies are shot, they rotate and tilt backward around the rotating axles; and when the multiple target bodies rotate to a bottom with the rotating frame, tilted target bodies rotate forward and stand upright under the action of gravity; and wherein the automatic rotating lifting target further comprises a turntable and multiple extension rods;

wherein a center of the turntable is fixedly connected to the output shaft of the driving mechanism, one end of the multiple extension rods is fixed to an outer peripheral side of the turntable, and the multiple mounting seats are respectively fixed to the other end of the multiple extension rods;

wherein the target bodies each comprises a flipping seat and a main body, a rear side of the flipping seat is rotatably connected to a rear side of each mounting seat around each rotating axle, and the main body is fixed to the flipping seat;

wherein the rotating axle and the flipping seat are a structure integrally injection molded, and the mounting seat is provided with a rotating groove for rotating connection with the rotating axle; and wherein one side of the rotating groove is set with an opening along an axial direction for installing the rotating axle, and a width of the opening is smaller than a diameter of the rotating axle.

2. The automatic rotating lifting target according to claim 1, wherein the flipping seat and the mounting seat are provided with magnet blocks for mutual magnetic attraction on one side close to each other.

3. The rotating automatic lifting target according to claim 1, wherein a periphery of the turntable is provided with multiple primary fixing columns, and the multiple extension rods are inserted and fixed to the primary fixing columns.

4. The automatic rotating lifting target according to claim 1, wherein the mounting seat is provided with a secondary fixing column, and each of the multiple extension rods is inserted and fixed to the secondary fixing column.

5. The automatic rotating lifting target according to claim 1, wherein the flipping seat is set with a connecting groove running through an end face of one side of the flipping seat to form a port; and the main body is provided with a connecting block fixed in the connecting groove through the port.

6. The automatic rotating lifting target according to claim 5, wherein a bottom surface of the connecting groove is designed with a positioning protrusion, and the connecting block is designed with a positioning recession for cooperating with the positioning protrusion.

7. The automatic rotating lifting target according to claim 1, wherein each of the extension rods is a hollow rod.

8. The automatic rotating lifting target according to claim 1, wherein the turntable comprises a rear shell, a front shell, and a front cover; and wherein the front shell is fixedly connected to the rear shell in a front-to-back splicing manner, and the front cover is provided on a front side of the front shell and has a tapered structure.

9. The automatic rotating lifting target according to claim 1, wherein the multiple extension rods are evenly distributed in a radial direction around the center of the turntable and extend outward in a radial pattern.

10. The automatic rotating lifting target according to claim 1, wherein the bracket comprises a base and a column; and wherein the column is fixedly connected to a top center of the base and extends vertically, and an upper end of the column is fixedly connected to the driving mechanism.

11. The automatic rotating lifting target according to claim 10, wherein the base is a counterweight base.

12. The automatic rotating lifting target according to claim 1, wherein the rotating frame is made of plastic material.

13. The automatic rotating lifting target according to claim 1, wherein the target bodies are made of plastic material.

14. The automatic rotating lifting target according to claim 1, wherein the driving mechanism comprises a housing, a control board, and a reduction motor; and wherein the housing is fixed on the top of the bracket, the control board and the reduction motor are fixed inside the housing; and wherein an output shaft of the reduction motor extends forward and gets out of the housing, and is fixedly connected to a center of the rotating frame.

15. The automatic rotating lifting target according to claim 14, wherein the housing comprises a lower shell, an upper shell, and a rear cover; and wherein the upper shell is vertically spliced and fixed with the lower shell to form a chamber, the control board and the reduction motor are arranged in the chamber, and the rear cover covers a rear opening of the chamber.

16. The automatic rotating lifting target according to claim 14, wherein a bottom of the housing has a plug hole, and the top of the bracket is inserted and fixed in the plug hole.

17. The automatic rotating lifting target according to claim 14, wherein the control board has control buttons exposed on an outer surface of the housing.

18. The automatic rotating lifting target according to claim 14, wherein the housing is provided with a rechargeable battery electrically connected to the control board, and the control board has a charging interface exposed on the outer surface of the housing.

* * * * *